US006598363B1

(12) United States Patent
Ferguson et al.

(10) Patent No.: US 6,598,363 B1
(45) Date of Patent: Jul. 29, 2003

(54) TEMPORARY BUILDING STRUCTURE

(76) Inventors: Sharon P. Ferguson, 9012 W. Greenfield Ave., West Allis, WI (US) 53214; Peter B. Ferguson, 9012 W. Greenfield Ave., West Allis, WI (US) 53214

( * ) Notice: Subject to any disclaimer, the term of this patent is extended or adjusted under 35 U.S.C. 154(b) by 54 days.

(21) Appl. No.: 09/860,328

(22) Filed: May 18, 2001

(51) Int. Cl.[7] ..... E04B 1/48; E04B 1/18

(52) U.S. Cl. ..... 52/272; 52/57; 52/79.9; 52/270; 52/79.3; 52/585.1; 52/91.1

(58) Field of Search ..... 52/43, 57, 73, 52/91.1, 91.3, 272, 275, 276, 282.1, 282.3, 282.4, 651.11, 653.1, 656.9, 79.5, 79.3, 281, 79.9, 270, 284, 285.1, 585.1

(56) References Cited

U.S. PATENT DOCUMENTS

| | | | | | |
|---|---|---|---|---|---|
| 1,830,382 | A | * | 11/1931 | Bemis | 52/79.5 |
| 2,293,569 | A | * | 8/1942 | Sonino | 52/79.5 |
| 2,396,828 | A | * | 3/1946 | Carpenter | 52/284 |
| 2,600,900 | A | * | 6/1952 | McNeill | 52/284 |
| 2,793,401 | A | * | 5/1957 | Paschke | 52/284 |
| 3,052,291 | A | | 9/1962 | Fellers | |
| 3,308,596 | A | * | 3/1967 | Cooper et al. | 52/79.5 |
| 3,727,355 | A | | 4/1973 | Vachon | |
| 3,880,405 | A | * | 4/1975 | Brueske | 256/59 |
| 4,873,797 | A | * | 10/1989 | Rydeen | 52/93 |
| 5,167,246 | A | | 12/1992 | Mortenson | |
| 5,184,436 | A | | 2/1993 | Sadler | |
| 5,579,796 | A | | 12/1996 | Mallo et al. | |
| 5,657,583 | A | * | 8/1997 | Tennant | 52/79.5 |
| 5,778,604 | A | * | 7/1998 | Snow | 52/66 |
| D404,092 | S | | 1/1999 | Stader | |
| 5,921,047 | A | * | 7/1999 | Walker | 52/585.1 |
| 6,073,404 | A | * | 6/2000 | Norfleet | 52/236.3 |
| 6,151,843 | A | * | 11/2000 | Weaver et al. | 52/92.2 |

FOREIGN PATENT DOCUMENTS

| | | | | |
|---|---|---|---|---|
| DE | 2832728 | * | 7/1980 | 52/284 |
| DE | 3801417 | * | 12/1988 | 52/284 |

* cited by examiner

*Primary Examiner*—Lanna Mai
*Assistant Examiner*—Phi Dieu Tran A

(57) ABSTRACT

A temporary building structure for providing a modular shelter which can be quickly set up and taken down. The temporary building structure includes a plurality of side panels each of which includes a top edge; and also includes a plurality of elongate side panel support members being securely attached along the top edges of the side panels; and further includes a plurality of cross beams being removably attached to the elongate panel support members; and also includes a plurality of roof panels being removably mounted upon the side panels and each having a top edge and a bottom edge; and further includes a plurality of elongate roof panel support members being attached along the top and bottom edges of the roof panels; and further includes at least one peak cap member being removably and securely attached upon the top edges of the roof panels.

11 Claims, 5 Drawing Sheets

20
19
16
15
19
18
20
12
19
13
16
18
19
15
18
20
14
12
11
11
26
23
27
30
19
25
12
21
22

11
20

TEMPORARY BUILDING STRUCTURE

BACKGROUND OF THE INVENTION

1. Field of the Invention

The present invention relates to portable building structures and more particularly pertains to a new temporary building structure for providing a modular shelter which can be quickly set up and taken down.

2. Description of the Prior Art

The use of portable building structures is known in the prior art. More specifically, portable building structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,184,436; U.S. Pat. No. 3,052,291; U.S. Pat. No. 5,167,246; U.S. Pat. No. 5,579,796; U.S. Pat. No. 3,727,355; and U.S. Pat. No. Des. 404,092.

While these devices fulfill their respective, particular objectives and requirements, the aforementioned patents do not disclose a new temporary building structure. The inventive device includes a plurality of side panels each of which includes a top edge; and also includes a plurality of elongate side panel support members being securely attached along the top edges of the side panels; and further includes a plurality of cross beams being removably attached to the elongate panel support members; and also includes a plurality of roof panels being removably mounted upon the side panels and each having a top edge and a bottom edge; and further includes a plurality of elongate roof panel support members being attached along the top and bottom edges of the roof panels; and further includes at least one peak cap member being removably and securely attached upon the top edges of the roof panels.

In these respects, the temporary building structure according to the present invention substantially departs from the conventional concepts and designs of the prior art, and in so doing provides an apparatus primarily developed for the purpose of providing a modular shelter which can be quickly set up and taken down.

SUMMARY OF THE INVENTION

In view of the foregoing disadvantages inherent in the known types of portable building structures now present in the prior art, the present invention provides a new temporary building structure construction wherein the same can be utilized for providing a modular shelter which can be quickly set up and taken down.

The general purpose of the present invention, which will be described subsequently in greater detail, is to provide a new temporary building structure which has many of the advantages of the portable building structures mentioned heretofore and many novel features that result in a new temporary building structure which is not anticipated, rendered obvious, suggested, or even implied by any of the prior art portable building structures, either alone or in any combination thereof.

To attain this, the present invention generally comprises a plurality of side panels each of which includes a top edge; and also includes a plurality of elongate side panel support members being securely attached along the top edges of the side panels; and further includes a plurality of cross beams being removably attached to the elongate panel support members; and also includes a plurality of roof panels being removably mounted upon the side panels and each having a top edge and a bottom edge; and further includes a plurality of elongate roof panel support members being attached along the top and bottom edges of the roof panels; and further includes at least one peak cap member being removably and securely attached upon the top edges of the roof panels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new temporary building structure which has many of the advantages of the portable building structures mentioned heretofore and many novel features that result in a new temporary building structure which is not anticipated, rendered obvious, suggested, or even implied by any of the prior art portable building structures, either alone or in any combination thereof.

It is another object of the present invention to provide a new temporary building structure which may be easily and efficiently manufactured and marketed.

It is a further object of the present invention to provide a new temporary building structure which is of a durable and reliable construction.

An even further object of the present invention is to provide a new temporary building structure which is susceptible of a low cost of manufacture with regard to both materials and labor, and which accordingly is then susceptible of low prices of sale to the consuming public, thereby making such temporary building structure economically available to the buying public.

Still yet another object of the present invention is to provide a new temporary building structure which provides in the apparatuses and methods of the prior art some of the advantages thereof, while simultaneously overcoming some of the disadvantages normally associated therewith.

Still another object of the present invention is to provide a new temporary building structure for providing a modular shelter which can be quickly set up and taken down.

Yet another object of the present invention is to provide a new temporary building structure which includes a plurality of side panels each of which includes a top edge; and also includes a plurality of elongate side panel support members being securely attached along the top edges of the side panels; and further includes a plurality of cross beams being removably attached to the elongate panel support members; and also includes a plurality of roof panels being removably mounted upon the side panels and each having a top edge and a bottom edge; and further includes a plurality of elongate roof panel support members being attached along the top and bottom edges of the roof panels; and further includes at least one peak cap member being removably and securely attached upon the top edges of the roof panels.

Still yet another object of the present invention is to provide a new temporary building structure that is easy and convenient to set up and use.

Even still another object of the present invention is to provide a new temporary building structure that allows the user to set up a shelter anywhere on one's property when needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
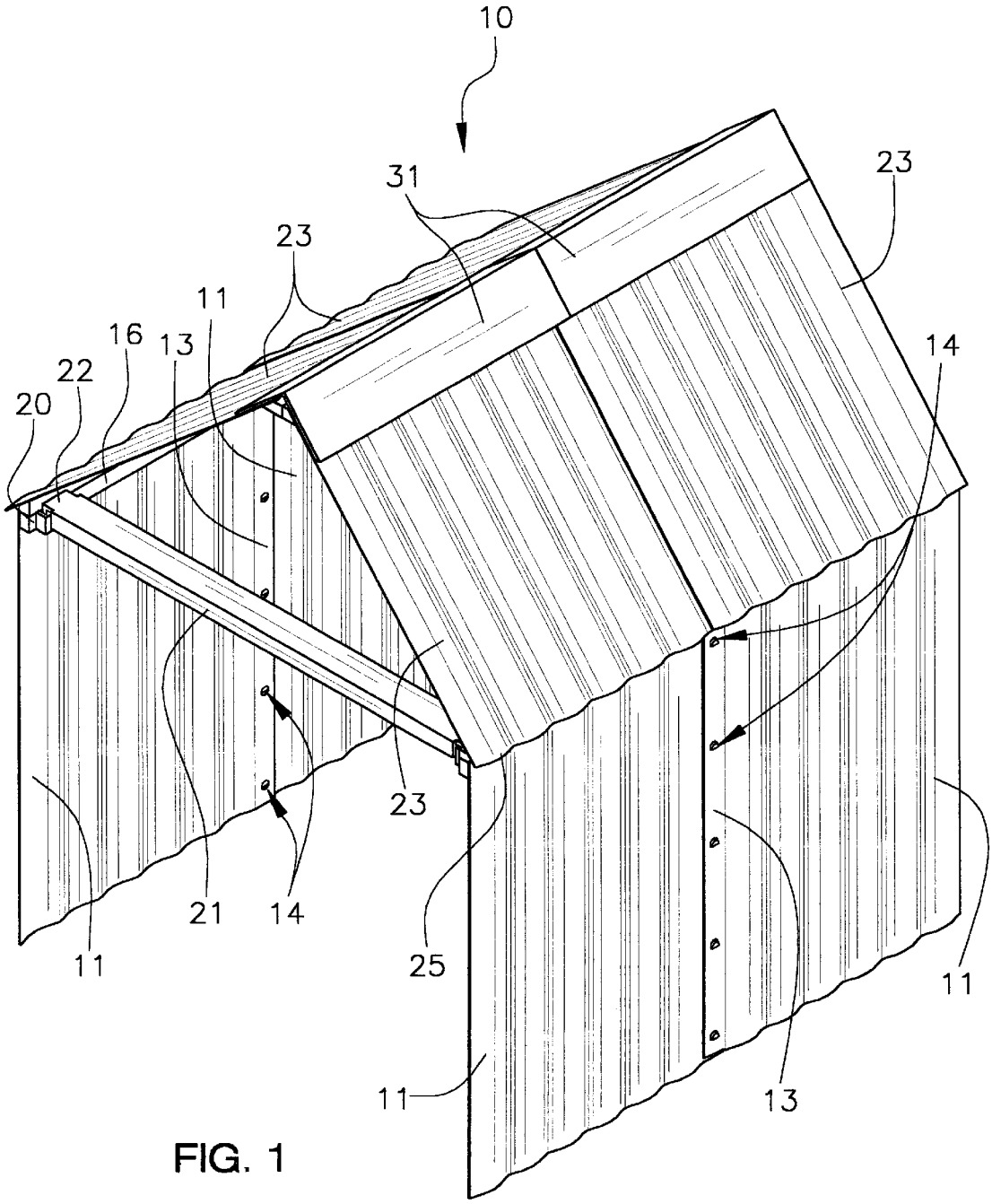
FIG. 1 is a perspective view of a new temporary building structure according to the present invention.
Figure 2:
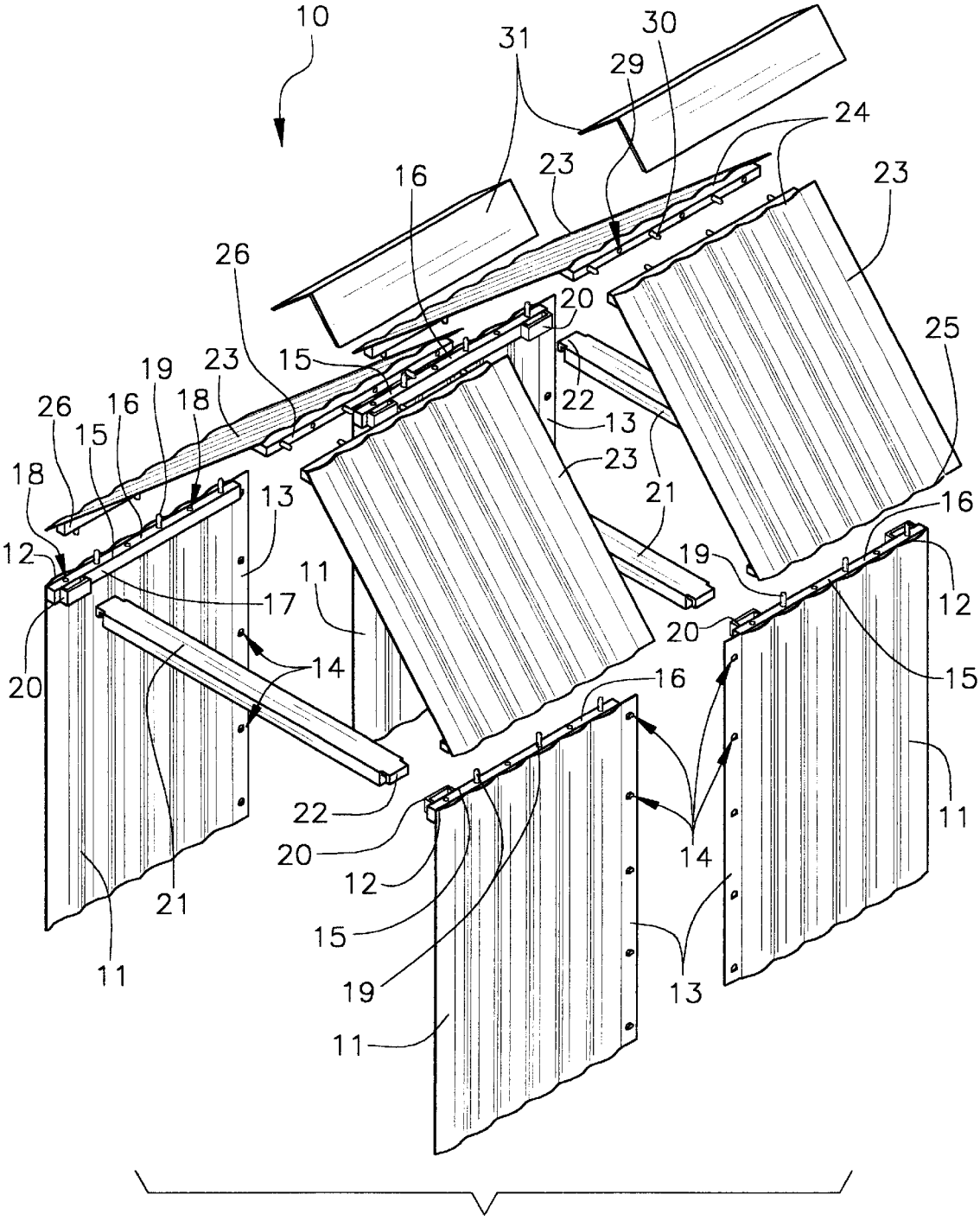
FIG. 2 is an exploded perspective view of the present invention.
Figures 3, 4:
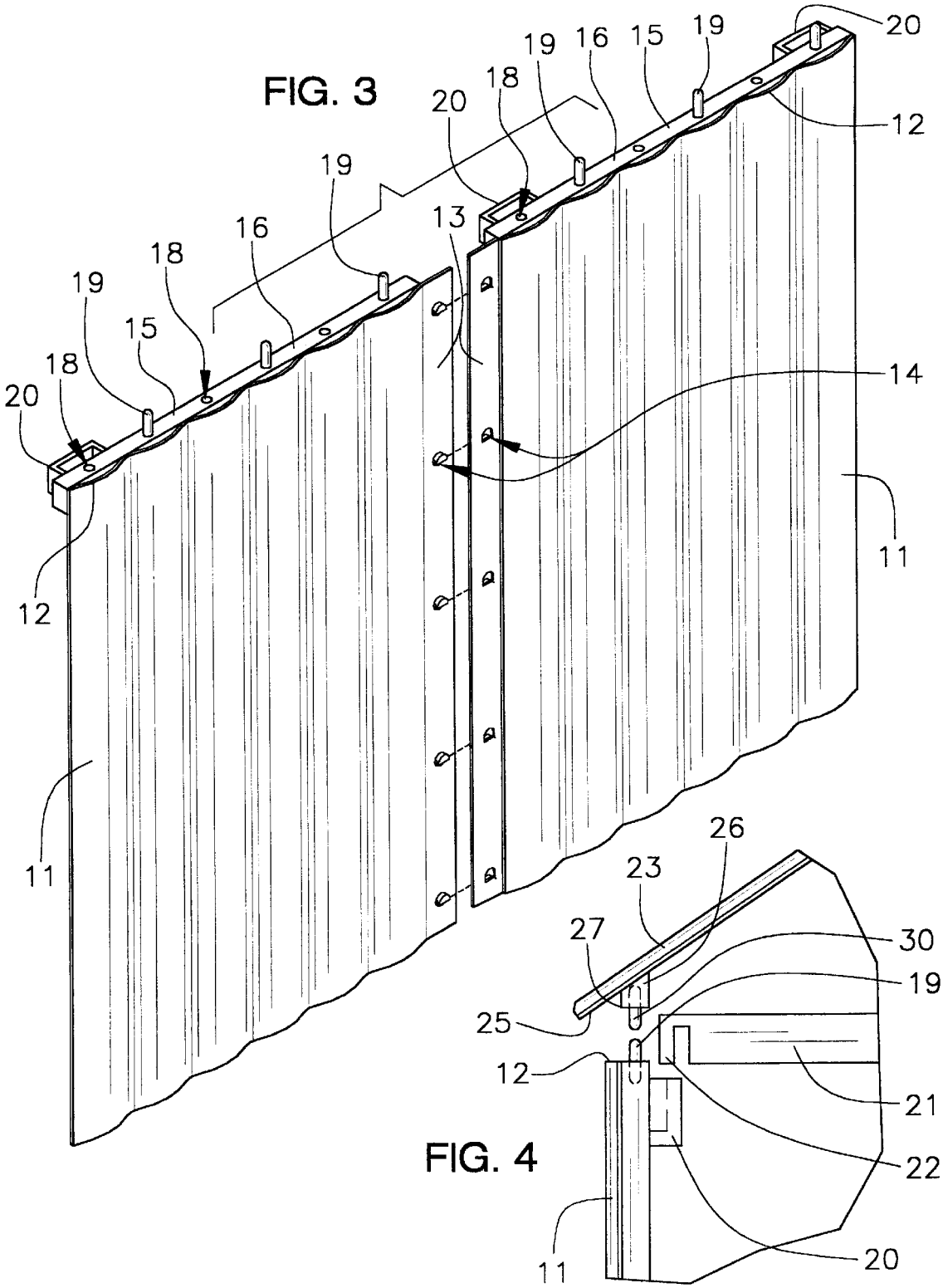
FIG. 3 is a perspective view of two of the side panels of the present invention.
FIG. 4 is an exploded detailed side elevational view of a corner of the present invention.
Figure 5:
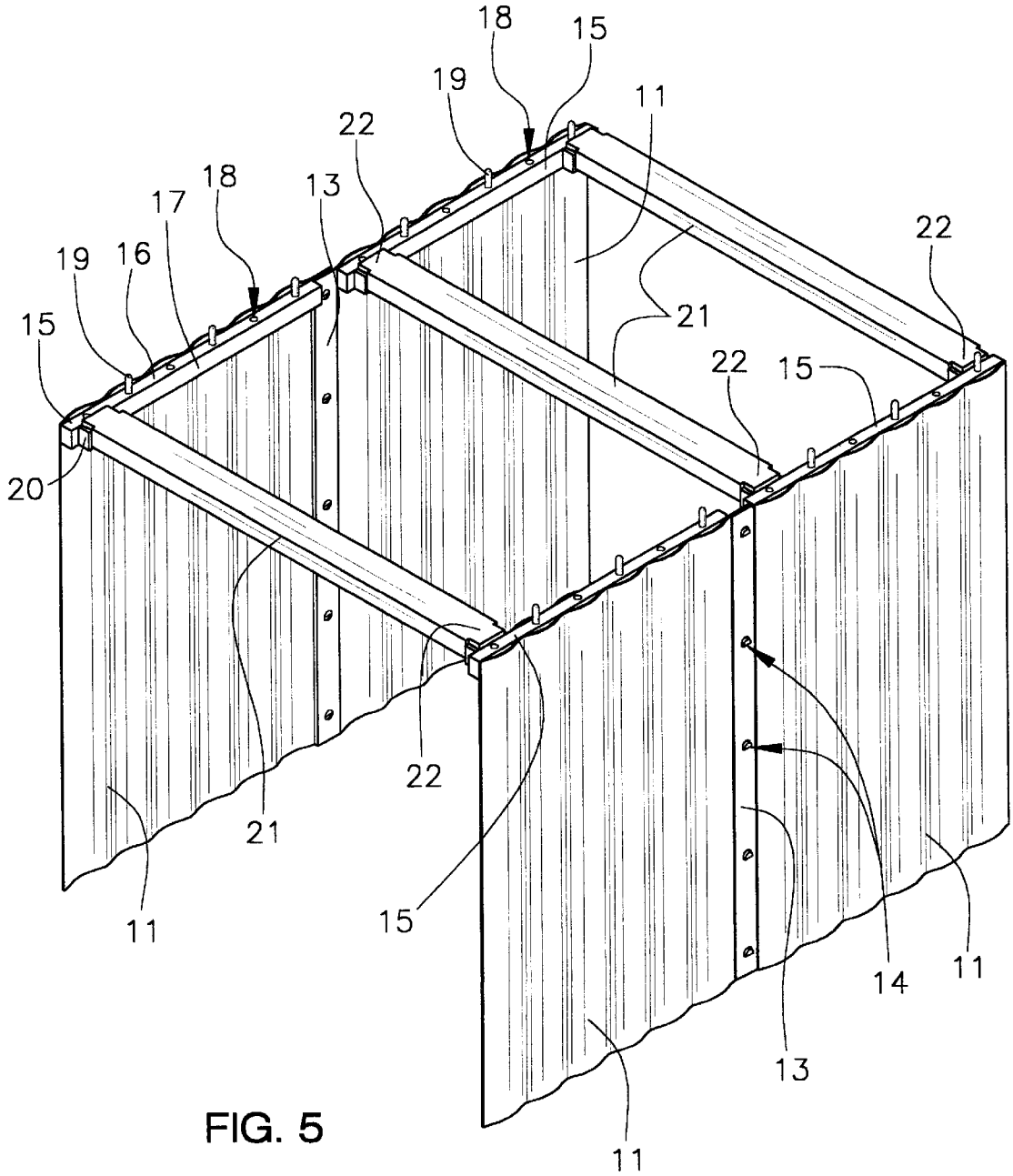
FIG. 5 is a perspective view of the side panels and cross beams of the present invention.
Figure 6:
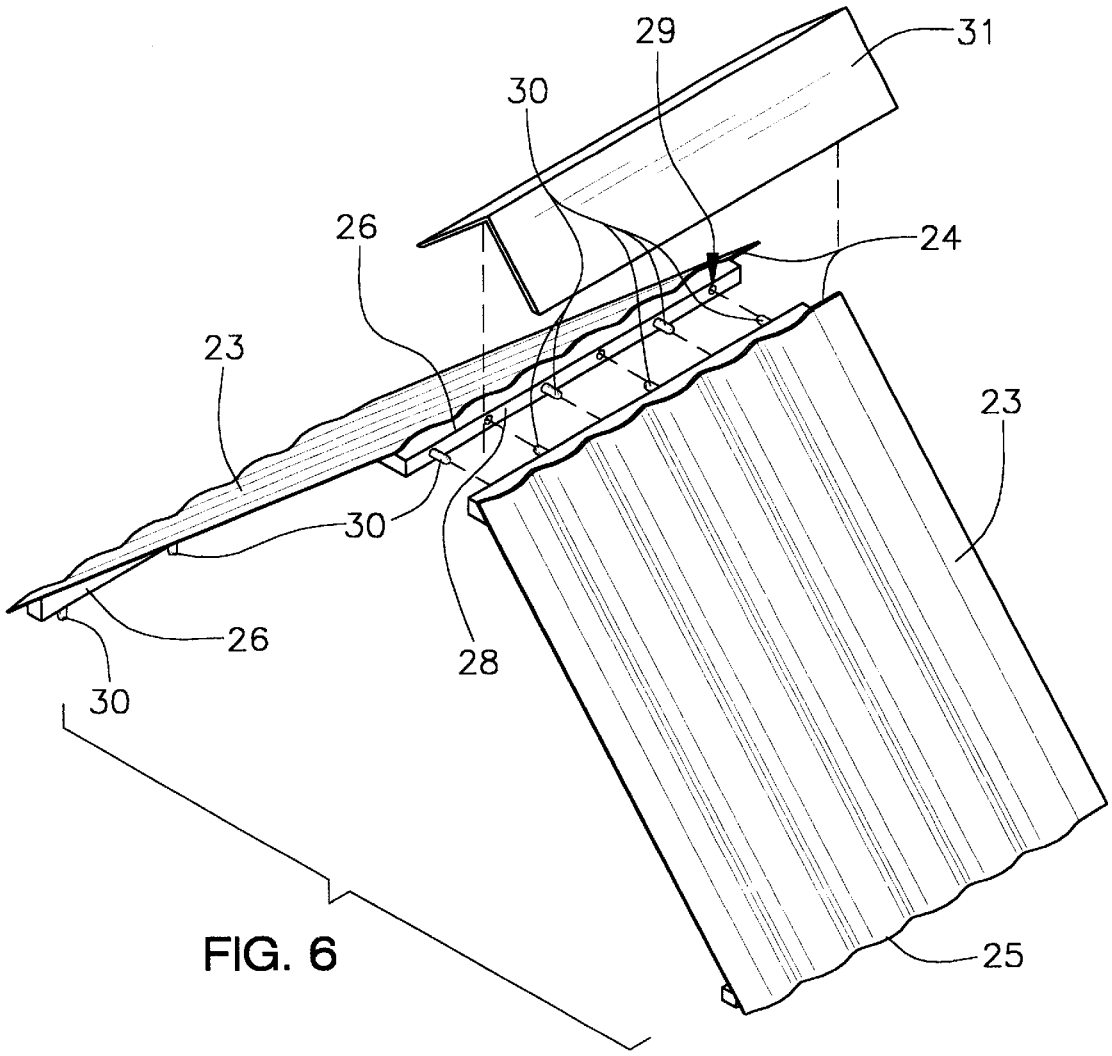
FIG. 6 is an exploded perspective view of the roof panels including panel support members and peak cap member of the present invention.
Figure 7:
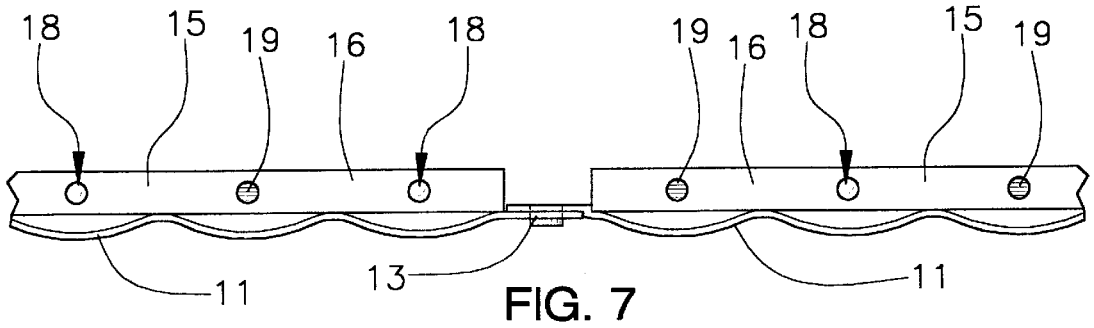
FIG. 7 is a top plan view of two of the side panels including elongate panel support members of the present invention.

With reference now to the drawings, and in particular to FIGS. 1 through 7 thereof, a new temporary building structure embodying the principles and concepts of the present invention and generally designated by the reference numeral 10 will be described.

As best illustrated in FIGS. 1 through 7, the temporary building structure 10 generally comprises a plurality of side panels 11 each of which includes a top edge 12. Each of the side panels 11 is corrugated and also has a longitudinal planar side end portion 13 having a plurality of holes 14 being spaced apart and being disposed therethrough. The side panels 11 include pairs of the side panels 11 with each pair of the side panels 11 including a first side panel 11 being fastened with fasteners along its longitudinal planar side end portion 13 to the longitudinal planar side end portion 13 of a second side panel 11.

A plurality of elongate side panel support members 15 are securely and conventionally attached along the top edges 12 of the side panels 11. Each of the elongate side panel support members 15 has a top 16, and includes a plurality of holes 18 being spaced apart and being disposed in the top 16, and further includes a plurality of dowels 19 being paced apart and being securely and conventionally disposed in the top, and also includes at least one ring-like bracket being securely and conventionally attached to a side 17 of the elongate side panel support member 15 near an end thereof.

A plurality of cross beams 21 are removably attached to the elongate panel support members 15. Each of the cross beams 21 includes hook-shaped end portions 22 being removably received in the ring-like brackets 20 of the elongate side panel support members 15 with the cross beams 21 extending between opposed the side panels 11.

A plurality of roof panels 23 are removably mounted upon the side panels 11 with each roof panel 23 having a top edge 24 and a bottom edge 25. Each of the roof panels 23 is also corrugated. The roof panels 23 and the side panels 11 are made of Polyvinylchloride.

A plurality of elongate roof panel support members 26 are conventionally attached along the top and bottom edges 24,25 of the roof panels 23. The elongate roof panel support members 26 include top elongate roof panel support members 26 being securely attached along the top edges 24 of the roof panels 23 with each having a side 28 and a plurality of holes 29 and dowels 30 being spaced apart and being conventionally disposed in the side 28 thereof, and also include bottom elongate roof panel support members 26 being securely attached along the bottom edges 25 of the roof panels 23 with each having a bottom 27 and a plurality of holes 29 and dowels 30 being spaced apart and being disposed in the bottom 27 thereof. Pairs of opposed top elongate roof panel support members 26 are removably attached to one another with the dowels 30 of one of the opposed top elongate roof panel support member 26 being removably received in the holes 29 of the other of the opposed top elongate roof panel support member 26. Each of the bottom elongate roof panel support members 26 are removably attached to a respective elongate side panel support members 15.

At least one peak cap member 31 is removably, securely, and conventionally attached upon the top edges 24 of the roof panels 23. The at least one peak cap member 31 includes at least one inverted V-shaped plate being securely attached upon the top edges 24 of the roof panels 23 over the elongate roof panel support members 26.

In use, the user stands up the side panels 11, and interconnects the side panels 11 with the cross beams 21, and then attaches the roof panels 23 to one another and to the side panels 11, and secures the peak cap member 31 upon the top edges 24 of the roof panels 23. The user can use the temporary building structure to shelter one's vehicle, or for other purposes such as having picnics.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A temporary building structure comprising:

a plurality of side panels each of which includes a top edge;

a plurality of elongate side panel support members being securely attached along said top edges of said side panels;

a plurality of cross beams being removably attached to said elongate panel support members;

a plurality of roof panels being removably mounted upon said side panels and each having a top edge and a bottom edge;

a plurality of elongate roof panel support members being attached along said top and bottom edges of said roof panels; and at least one peak cap member being removably and securely attached upon said top edges of said roof panels;

wherein each of said elongate side panel support members has a top, and includes a plurality of holes being spaced apart and being disposed in said top, and further includes a plurality of dowels being spaced apart and being securely disposed in said top, and also includes a ring-like bracket being securely attached to a side of said elongate side panel support member near an end thereof; and wherein said elongate roof panel support members include top elongate roof panel support members being securely attached along said top edges of said roof panels and each having a side and a plurality of holes and dowels being spaced apart and being disposed in said side thereof, and also include bottom elongate roof panel support members being securely attached along said bottom edges of said roof panels and each having a bottom and a plurality of holes and dowels being spaced apart and being disposed in said bottom thereof, pairs of opposed said top elongate roof panel support members being removably attached to one another with said dowels of one of said opposed said top elongate roof panel support member being removably received in said holes of the other of said opposed said top elongate roof panel support member, each of said bottom elongate roof panel support members being removably attached to a respective said elongate side panel support members.

2. A temporary building structure as described in claim 1, wherein each of said side panels is corrugated and also has a longitudinal planar side end portion having a plurality of holes being spaced apart and being disposed therethrough.

3. A temporary building structure as described in claim 2, wherein said side panels includes pairs of said side panels with each said pair of said side panels including a first side panel being fastened with fasteners along its said longitudinal planar side end portion to said longitudinal planar side end portion of a second side panel.

4. A temporary building structure as described in claim 1, wherein each of said cross beams includes hook-shaped end portions being removably received in said ring-like brackets of said elongate side panel support members, said cross beams extending between opposed said side panels.

5. A temporary building structure as described in claim 1, wherein said at least one peak cap member includes at least one inverted V-shaped plate being securely attached upon said top edges of said roof panels over said elongate roof panel support members.

6. A temporary building structure comprising:

a plurality of side panels each of which includes a top edge;

a plurality of side panel support members attached along said top edges of said side panels;

a plurality of roof panels removably mounted upon said side panels and each having a top edge and a bottom edge;

a plurality of elongate roof panel support members attached along said top and bottom edges of said roof panels; and wherein each of said elongate side panel support members includes:

a top;

a plurality of holes being spaced apart and being disposed in said top;

a plurality of dowels being spaced apart and being disposed in said top; and a ring bracket being attached to a side of said elongate side panel support member near an end thereof; and wherein said elongate roof panel support members include:

top elongate roof panel support members attached along said top edges of said roof panels and each having a side and a plurality of holes and dowels being spaced apart and being disposed in said side thereof;

bottom elongate roof panel support members attached along said bottom edges of said roof panels and each having a bottom and a plurality of holes and dowels being spaced apart and being disposed in said bottom thereof; and pairs of opposed said top elongate roof panel support members being removably attached to one another with said dowels of one of said opposed said top elongate roof panel support member being removably received in said holes of the other of said opposed said top elongate roof panel support member, each of said bottom elongate roof panel support members being removably attached to a respective said elongate side panel support members.

7. A temporary building structure as described in claim 6, wherein each of said side panels is corrugated and also has a longitudinal planar side end portion having a plurality of holes being spaced apart and being disposed therethrough.

8. A temporary building structure as described in claim 7, wherein said side panels includes pairs of said side panels with each said pair of said side panels including a first side panel being fastened with fasteners along its said longitudinal planar side end portion to said longitudinal planar side end portion of a second side panel.

9. A temporary building structure as described in claim 6, additionally comprising a plurality of cross beams removably attached to said elongate panel support members, and each of said cross beams including hook-shaped end portions being removably received in said ring brackets of said elongate side panel support members, said cross beams extending between opposed said side panels.

10. A temporary building structure as described in claim 6, additionally comprising at least one peak cap member being removably attached upon said top edges of said roof panels, said at least one peak cap member including at least one inverted V-shaped plate being securely attached upon said top edges of said roof panels over said elongate roof panel support members.

11. A temporary building structure comprising:

a plurality of side panels each of which includes a top edge, each of said side panels being corrugated and also having a longitudinal planar side end portion having a plurality of holes being spaced apart and being disposed therethrough, said side panels including pairs of said side panels with each said pair of said side panels including a first side panel being fastened with fasteners along its said longitudinal planar side end portion to said longitudinal planar side end portion of a second side panel;

a plurality of elongate side panel support members being securely attached along said top edges of said side panels, each of said elongate side panel support members having a top, and including a plurality of holes being spaced apart and being disposed in said top, and further including a plurality of dowels being paced apart and being securely disposed in said top, and also including a ring-like bracket being securely attached to a side of said elongate side panel support member near an end thereof;

a plurality of cross beams being removably attached to said elongate panel support members, each of said cross beams including hook-shaped end portions being removably received in said ring-like brackets of said elongate side panel support members, said cross beams extending between opposed said side panels;

a plurality of roof panels being removably mounted upon said side panels and each having a top edge and a bottom edge, each of said roof panels also being corrugated, said roof panels and said side panels being made of Polyvinylchloride;

a plurality of elongate roof panel support members being attached along said top and bottom edges of said roof panels, said elongate roof panel support members including top elongate roof panel support members being securely attached along said top edges of said roof panels and each having a side and a plurality of holes and dowels being spaced apart and being disposed in said side thereof, and also including bottom elongate roof panel support members being securely attached along said bottom edges of said roof panels and each having a bottom and a plurality of holes and dowels being spaced apart and being disposed in said bottom thereof, pairs of opposed said top elongate roof panel support members being removably attached to one another with said dowels of one of said opposed said top elongate roof panel support member being removably received in said holes of the other of said opposed said top elongate roof panel support member, each of said bottom elongate roof panel support members being removably attached to a respective said elongate side panel support members; and at least one peak cap member being removably and securely attached upon said top edges of said roof panels, said at least one peak cap member including at least one inverted V-shaped plate being securely attached upon said top edges of said roof panels over said elongate roof panel support members.

* * * * *